United States Patent [19]

Mess et al.

[11] 4,016,696

[45] Apr. 12, 1977

[54] TIE ROD HOLE PLUG IN COMBINATION WITH A WALL HOLE

[75] Inventors: Richard C. Mess, Washington Township, Montgomery County, Ohio; Dusan Tausanovitch, Northport, N.Y.

[73] Assignee: The Dayton Sure-Grip & Shore Co., Miamisburg, Ohio

[22] Filed: Apr. 4, 1975

[21] Appl. No.: 565,000

[52] U.S. Cl. ..... 52/514; 29/278; 52/127; 52/173 R; 52/704; 85/DIG. 2

[51] Int. Cl.[2] ..... E04F 19/00; E04G 23/02

[58] Field of Search ..... 52/127, 173, 302, 514, 52/704; 16/2; 85/80, DIG. 2; 220/233, 234, 235, 236, 237, 238; 249/216, 217; 138/89

[56] References Cited

UNITED STATES PATENTS

| | | | |
|---|---|---|---|
| 2,088,955 | 8/1937 | Hamill | 85/DIG. 2 |
| 2,150,080 | 3/1939 | Rawlings | 85/DIG. 2 |
| 2,165,192 | 7/1939 | Muirhead | 52/704 |
| 2,976,345 | 3/1961 | Whitted | 85/80 |
| 3,200,984 | 8/1965 | Fueslein | 138/89 |
| 3,358,869 | 12/1967 | Palmer | 138/89 |
| 3,390,498 | 7/1968 | Roy | 52/514 |
| 3,437,309 | 4/1969 | Tausanovitch | 249/216 |
| 3,604,591 | 9/1971 | Seltzer | 220/233 |

*Primary Examiner*—Leslie Braun
*Attorney, Agent, or Firm*—Biebel, French & Nauman

[57] ABSTRACT

A resilient plug for closing and sealing the opening formed in a concrete wall by the removal of the tie rod used to support the walls forms. The elastic plug is formed with a tapered socket and has a smooth outer surface, including a tapered leading end and a main body section having a larger diameter than the hole in the concrete and extending from the leading end. The plug is engaged in a tie rod hole by inserting a rod into the socket and pushing the plug into the tie rod hole. This causes an elongation of the plug, reducing its diameter and facilitating its insertion into the tie rod hole. However, when the force applied to the plug during insertion is removed the plug expands radially, forming a tight seal with the wall of the tie rod hole.

6 Claims, 7 Drawing Figures

PRIOR ART FIG-1
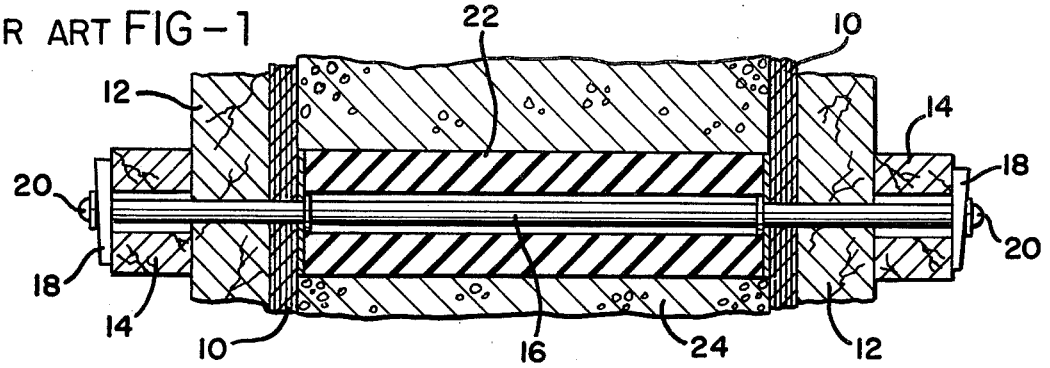
FIG-2 PRIOR ART
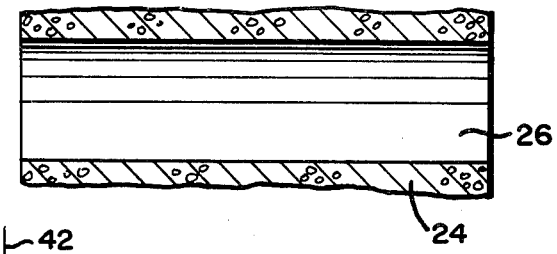
FIG-3
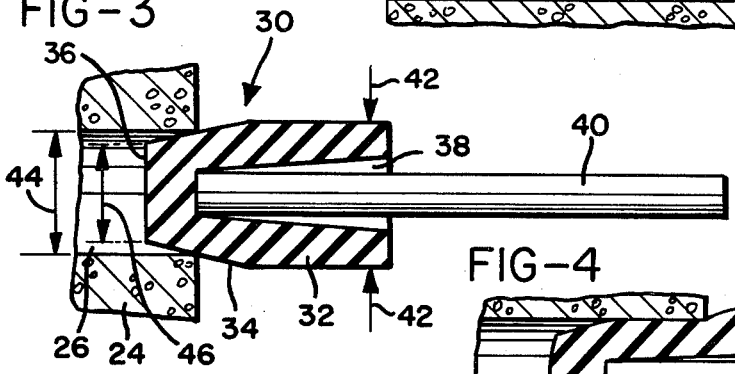
FIG-4
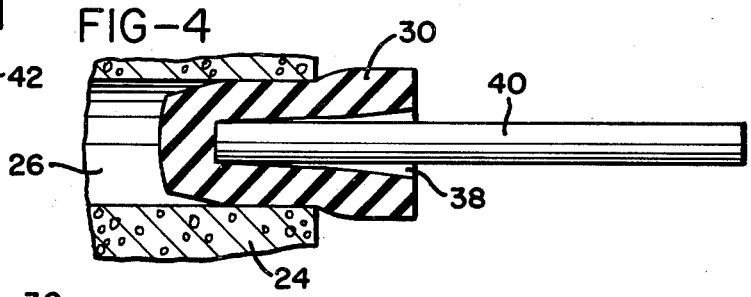
FIG-5
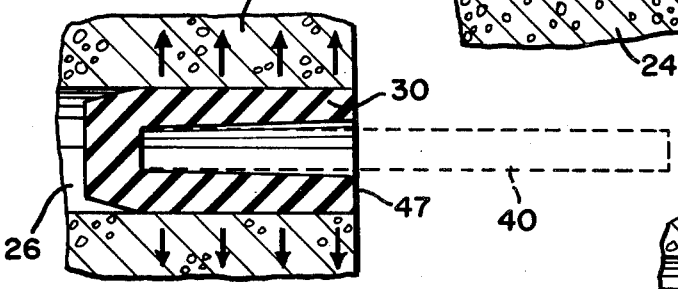
FIG-6
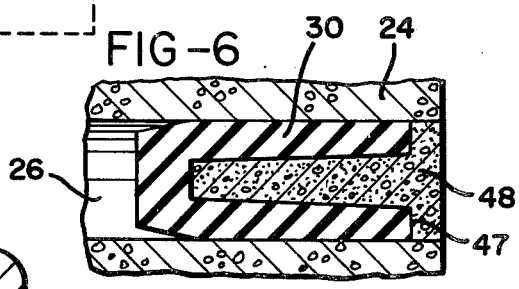
FIG-7
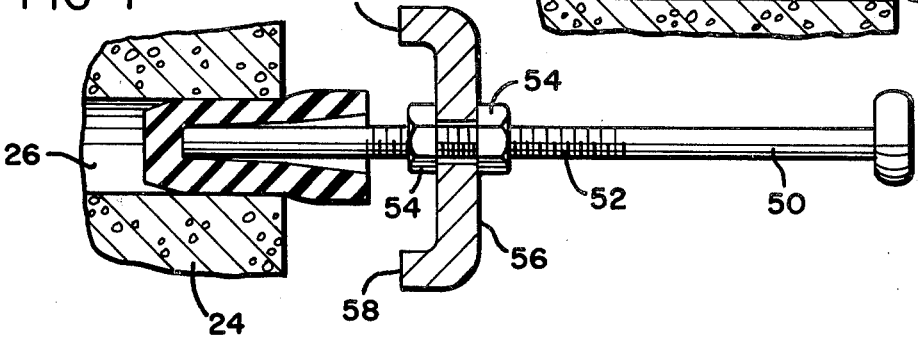

TIE ROD HOLE PLUG IN COMBINATION WITH A WALL HOLE

BACKGROUND OF THE INVENTION

One common type of tie rod utilized for supporting the forms used in pouring concrete walls is a break back tie rod which is manufactured with weakened sections which permit the rod to be broken off a short distance inwardly of both faces of the wall when the wall forms are removed. A section of the tie rod, therefore, remains embedded in the wall and the openings extending from the broken ends of the tie rod to the faces of the wall are usually sealed with grout or the like.

In a more recently developed form of tie rod, as shown, for example, in U.S. Pat. No. 3,437,309, the tie rod is surrounded by a sleeve which allows the tie rod to be removed from a wall and reused, resulting not only in a savings in material costs, but also requiring less labor for tie rod removal.

However, the reusable type of tie rod results in an opening extending completely through the wall, which not only may be considered aesthetically undesirable, but results in an unacceptable construction where the function of the wall requires that it be imperforate as, for example, where it forms a barrier against water. In this regard, it should be noted that substantial hydrostatic pressure may often be encountered acting against the face of the wall.

While conventional practice is to attempt to grout the tie rod openings formed through a wall, this is obviously an expensive method and often results in an unacceptable seal, due in part at least to the normal shrinkage associated with the curing of the grout after it has been placed into the tie rod hole.

One solution to this problem has been proposed in U.S. Pat. No. 3,390,498, wherein a polyethylene plug is disclosed which is adapted to be packed into a tie rod hole, the outer surface of the plug having circumferential ribs for anchoring the plug in place and preventing water seepage through the hole.

SUMMARY OF THE INVENTION

In accordance with the present invention, a plug is provided for the hole formed through a concrete wall by the removal of a reusable tie rod which is inexpensive in construction, extremely easy to install and yet provides a superior seal.

The plug is formed of resilient material and consists of a main body section and a tapered leading section, both having smooth outer surfaces. The plug is hollow, at least in the region of the main body section, forming a socket for receiving an installing tool, such as a section of tie rod.

With a rod received within the hollow plug, the main body section of the plug, which has an outside diameter greater than the diameter of the tie rod hole to be plugged, is pushed into the tie rod hole by the rod received in the plug.

As the leading end of the plug moves into the tie rod hole, the plug will tend to elongate, reducing its diameter and allowing the plug to slip easily into the tie rod hole. However, upon removal of the insertion force applied to the plug, it will tend to contract to its normal length, expanding radially into sealing engagement with the wall of the tie rod hole.

While the plug is extremely easy to insert into the hole it cannot be dislodged under most conditions encountered in the field. In fact, any force tending to push the plug back out of the tie rod hole will tend to increase the sealing force exterted by the outer surface of the plug on the wall of the tie rod hole.

If desired, instead of using simply a length of rod for installing the plug, a tool may be provided in accordance with the greatest invention which will permit installation of a plug automatically to the desired depth within the hole.

If desired, the plug may be formed of a material such as neoprene and colored approximately the same color as the concrete wall within which it is received. The plug can then be inserted to a point where its trailing end is flush with the wall face, or it can be inserted in somewhat beyond that point and a small filling of grout utilized to present a smooth unbroken wall face.

From the above and the following description it will be seen that the present invention provides a tie rod hole plug which is not only of inexpensive construction, but is relatively simple to install and provides excellent sealing properties.

BRIEF DESCRIPTION OF THE DRAWINGS

FIG. 1 is a cross sectional view through a typical concrete wall and associated formwork;

FIG. 2 is a view similar to FIG. 1, but with the formwork removed;

FIGS. 3–5 are cross sectional views showing installation of the plug of the present invention;

FIG. 6 is a cross sectional view showing a grout filling applied over the plug; and FIG. 7 illustrates the use of a special installation tool.

DESCRIPTION OF THE PREFERRED EMBODIMENT

FIG. 1 of the drawings shows a typical wall construction utilizing a reusable form tie. Thus, a pair of wall forms 10 are held in place by upright studs 12, horizontal wales 14 and a tie rod 16. Wedges or the like 18 are received over heads 20 on opposite ends of the tie rod and a sleeve 22 encircles the central portion of the tie rod and permits withdrawal following removal of the formwork.

While this permits the tie rod to be reused and decreases the amount of labor associated with this operation, removal of the tie rod rather than simply breaking off its ends results in an opening extending through the concrete wall 24, as seen at 26 in FIG. 2 of the drawings. To seal this opening in accordance with the present invention, a plug 30 is provided, as seen in FIG. 3.

Plug 30 includes a main body section 32 and a tapered nose section 34 having a flat leading end 36. The plug is hollow throughout at least the extent of the main body section and preferably extending into the portion 34 of the plug. This defines a socket 38 of tapered configuration adapted to receive a tool, such as a section of rod 40, for inserting the plug into the opening.

It will also be noted as the description proceeds that it is unnecessary to deform the outer surface of the plug to provide a good seal and prevent its dislodgement. The outer surface of the plug is, therefore, substantially smooth and uninterrupted, facilitating not only manufacture thereof but also insertion of the plug into a tie rod hole.

The dimensions of the plug are selected such that the outside dimension of the body section, indicated by the arrows 42, is greater than the inside dimension of the tie rod hole 26 indicated by the arrow 44. The nose section 34 tapers rearwardly from an outside dimension 46 at the leading end 36 thereof which is less than that of the opening 26 to a maximum dimension which is the same as that of the main body section.

With this construction, as seen in FIGS. 4 and 5, when the tool 40 is received within the socket 38, the leading end of the plug may be inserted into the opening 26. As the leading end continues to move into the opening the plug will be stretched axially, resulting in a decrease in diameter and allowing the plug to slip easily into hole 26.

After the plug has been inserted to the desired depth within the opening 26, the force applied to the rod 40 is then relaxed and the rod removed. The plug then tends to contract axially, resulting in a radially outwardly acting force as indicated by the arrows in FIG. 5 of the drawings. Thereafter, the plug forms a tight seal with the walls of the tie rod hole and is extremely difficult to dislodge.

If desired the plug can be inserted to a point where its trailing end 47 is flush with the face of the wall, as in FIG. 5, or it can be counter sunk to any desired depth and grouted as indicated at 48 in FIG. 6 the drawings.

While in the above description a section of rod is described as the installing tool, a special installation tool in accordance with the present invention may also be used to advantage, particularly where it is desired to insert the plug to a particular depth and yet avoid the care which might normally be associated with this operation.

Thus, as seen in FIG. 7, a section of rod 50 is provided with a threaded portion 52 receiving a pair of nuts 54 on opposite sides of a spider 56 having feet 58. It will be apparent that with the spider 56 locked in position on the rod 50 by the nuts 54 the feet 58 automatically act as stops to provide the desired depth of penetration of the plug 30 into the opening 24.

While in the above description a plug of substantially circular cross section is illustrated, it will be apparent that the cross sectional configuration of the plug perpendicularly to its axis may be shaped, as desired, to conform to the cross sectional shape of the opening formed in the wall by the removal of the tie rod.

While the articles herein described constitute preferred embodiments of the invention, it is to be understood that the invention is not limited to these precise articles and that changes may be made therein without departing from the scope of the invention.

What is claimed is:

1. In combination with a wall having a hole formed therein as the result of the removal of a tie rod therefrom, an improved tie rod hole plug received in said hole comprising:

a. a main body section having prior to insertion into said hole an outside dimension in a plane perpendicular to the longitudinal axis of said plug greater than the correspondng inside dimension of said hole whereby said body portion exerts a radially outward sealing force against the surface defining said hole which increases in response to forces tending to push said plug outwardly from said hole, b. said plug gripping said surface of said hole solely by reason of said radial expansion of said plug after insertion thereof into said hole, c. a nose section formed integrally with said main body section and having an outside dimension adjacent a leading end thereof in a plane perpendicular to said longitudinal axis of said plug less than said inside dimension of said hole, d. said nose section tapering from said leading end thereof to said main body section, e. said leading end of said tapered nose section being substantially flat, f. the outer surface of said main body and nose sections being substantially smooth and free of grooves and ribs, g. means defining a tool-receiving socket extending axially of said plug within said main body section thereof and being closed at said leading end of said nose section, and h. said tool-receiving socket being substantially void of plug-expending means.

2. The combination of claim 1 wherein:

a. said main body section is of uniform outside dimension.

3. The combination of claim 1 wherein:

a. said socket is tapered from a smallest dimension adjacent the leading end of said plug outwardly toward the trailing end of said plug.

4. The combination of claim 1 wherein:

a. said main body section is of circular cross sectional configuration.

5. The combination of claim 1 wherein:

a. said wall and said plug are substantially the same color.

6. A wall and plug assembly comprising:

a. a concrete wall having a tie rod hole extending therethrough from one face thereof to the other, b. a resilient, one-piece tie rod hole plug of molded construction received within said hole, c. said plug having a cylindrical main body section of circular cross sectional configuration having a smooth, uninterrupted outer surface, d. a conical nose section formed integrally with said main body section and tapering from a smallest dimension adjacent a leading end thereof to a largest dimension at its juncture with said main body section, e. a tool receiving socket defined in said plug concentrically with the outer surface of said plug, f. said tool receiving socket extending throughout said main body section and terminating with said nose section adjacent said leading end thereof, g. said tool receiving socket tapering from a smallest dimension adjacent said leading end of said nose section to a largest dimension at a trailing end of said main body section, h. said plug being received within said hole in said wall with said trailing end of said main body section disposed inwardly of said one face of said wall and said leading end of said nose section is disposed closer to said outer face of said wall than said one face thereof, and i. a filling of grout received within said socket of said plug and that portion of said hole extending from said trailing end of said plug to said one face of said wall.

* * * * *